US010886609B2

(12) United States Patent
Lenive et al.

(10) Patent No.: US 10,886,609 B2
(45) Date of Patent: Jan. 5, 2021

(54) ANTENNA ARRANGEMENT

(71) Applicant: Huawei Technologies Co., Ltd., Shenzhen (CN)

(72) Inventors: Vlad Lenive, Kista (SE); Alf Ahlström, Kista (SE)

(73) Assignee: Huawei Technologies Co., Ltd., Shenzhen (CN)

( * ) Notice: Subject to any disclaimer, the term of this patent is extended or adjusted under 35 U.S.C. 154(b) by 45 days.

(21) Appl. No.: 16/170,740

(22) Filed: Oct. 25, 2018

(65) Prior Publication Data

US 2019/0148827 A1 May 16, 2019

Related U.S. Application Data

(63) Continuation of application No. PCT/EP2016/059234, filed on Apr. 26, 2016.

(51) Int. Cl.
*H01Q 1/52* (2006.01)
*H01P 1/203* (2006.01)
(Continued)

(52) U.S. Cl.
CPC ..... *H01Q 1/523* (2013.01); *H01P 1/203* (2013.01); *H01P 1/2039* (2013.01);
(Continued)

(58) Field of Classification Search
CPC ..... H01Q 1/523; H01Q 21/0025; H01Q 7/00; H01Q 9/42; H01Q 1/52; H01P 1/20381; H01P 1/2039; H01P 1/203; H01P 1/213
(Continued)

(56) References Cited

U.S. PATENT DOCUMENTS 5,517,203 A 5/1996 Fiedziuszko
5,793,258 A * 8/1998 Lange ..... H01Q 19/28 343/789
(Continued)

FOREIGN PATENT DOCUMENTS

CN 1434539 A 8/2003
CN 101931113 A 12/2010
(Continued)

*Primary Examiner* — Hai V Tran
(74) *Attorney, Agent, or Firm* — Leydig, Voit & Mayer, Ltd.

(57) ABSTRACT

An antenna arrangement is described which comprises an electrical conductor extending along an axis, a first electrically conductive disc in contact with the electrical conductor and extending perpendicularly from the axis, a second electrically conductive disc in contact with the conductor and extending perpendicularly from the axis. The antenna arrangement also comprises an electrically conductive housing enclosing, circumferentially around the axis, the electrical conductor, the first electrically conductive disc and the second electrically conductive disc, feeding means configured to feed electromagnetic energy to the first electrically conductive disc, transmitting means configured to transmit electromagnetic energy from the second electrically conductive disc, and a third electrically conductive disc in contact with the conductor and extending perpendicularly from the axis between the first electrically conductive disc and the second electrically conductive disc at a distance therefrom. The third electrically conductive disc comprises at least one opening.

14 Claims, 15 Drawing Sheets

(51) Int. Cl.

| | |
|---|---|
| ***H01P 1/213*** | (2006.01) |
| ***H01Q 7/00*** | (2006.01) |
| ***H01Q 9/42*** | (2006.01) |
| ***H01Q 21/00*** | (2006.01) |

(52) U.S. Cl.
CPC ..... *H01P 1/20381* (2013.01); *H01P 1/213* (2013.01); *H01Q 1/52* (2013.01); *H01Q 7/00* (2013.01); *H01Q 9/42* (2013.01); *H01Q 21/0025* (2013.01)

(58) Field of Classification Search
USPC ..... 343/772
See application file for complete search history.

(56) References Cited

U.S. PATENT DOCUMENTS

| | | | | |
|---|---|---|---|---|
| 7,498,989 | B1 * | 3/2009 | Volman | H01Q 1/287 343/700 MS |
| 2003/0184407 | A1 * | 10/2003 | Tsunoda | H01P 1/202 333/110 |
| 2015/0255845 | A1 * | 9/2015 | Heid | H01Q 21/0012 343/776 |

FOREIGN PATENT DOCUMENTS

| | | | |
|---|---|---|---|
| CN | 102938487 | A | 2/2013 |
| EP | 1328038 | A2 | 7/2003 |
| EP | 2270926 | A1 | 1/2011 |
| JP | H11284410 | A | 10/1999 |
| RU | 2031495 | C1 | 3/1995 |

* cited by examiner

ANTENNA ARRANGEMENT

CROSS-REFERENCE TO RELATED APPLICATIONS

This application is a continuation of International Application No. PCT/EP2016/059234, filed on Apr. 26, 2016, the disclosure of which is hereby incorporated by reference in its entirety.

TECHNICAL FIELD

Embodiments of the present disclosure relate to an antenna arrangement suitable for use in an antenna array.

BACKGROUND

Base stations and micro base stations often employ multi-beam antenna (MBA) arrays. Wireless communication in densely populated areas is facing the problem of intense utilization of available spectrum. The use of MBA arrays and multiple-input-multiple-output (MIMO) antenna arrays is a promising way to address this problem by providing spatial spectrum re-use to increase the existing capacity.

Important features of MIMO antenna arrays that are desirable to achieve are: polarization orthogonality across a wide angle of directions, low side lobes capability and wide angle scanning capability. To achieve said features requires a dense packing of antenna elements with good polarization isolation over a wide range of directions and with low inter-element coupling, and low directivity. A cost effective implementation is also desirable to achieve. A cost-effective implementation calls for specific manufacturability requirements with special emphasize on the polarization orthogonality and low off-boresight level of cross-polarization. Traditionally, antennas exhibiting these features are circular or square waveguides, smooth-wall horns or corrugated horns, used in satellite communications in C-band and Ku-band as prime-focus reflector antenna feeds. Half wave dipoles and patches of different configurations are the most common elements used in base station antennas. However, large arrays are not common in traditional antenna arrays. Traditional base station antennas usually use linear arrays of around 8 to 10 elements. When additional requirements, such as relatively high antenna gain, low side-lobes and limited cross-section, are applied the selection of a suitable antenna element type becomes difficult.

SUMMARY

An objective of embodiments of the present disclosure is to provide an antenna arrangement which diminishes the problems with conventional solutions.

Another objective of embodiments of the present disclosure is to provide an antenna arrangement which enables a dense packing of antenna arrangements.

A further objective of embodiments of the present disclosure is to provide an antenna arrangement which provides frequency filtering.

The above objectives are fulfilled by the subject matter of the independent claims. Further advantageous implementation forms of the present disclosure can be found in the dependent claims.

With regard to an antenna array comprising a number of antenna arrangements the following properties may be important:

1. The array should be dense, i.e. no more than half a wavelength between element phase centers, in order to allow beam forming with controlled side lobes.
2. The antenna element directivity should be low, preferably close to isotropic (or "half sphere") in order to allow maximum flexibility for scanning.
3. Coupling between the antenna elements should be low to avoid load pulling between antenna elements.
4. It is important to have frequency rejection which requires the incorporation of a frequency filter. Since the antenna elements and thus also the antenna element drivers will be densely packed, there is no space for traditional low loss high selectivity filters.
5. The antenna array can provide space for filtering function to a greater extent than the back of the antenna array can. This is due to the need for other features such as, e.g., common clocking, data feed, and power feed, on the back of the antenna array.
6. If filters and antennas are integrated in their functionality, the impact of the filters on the radiation properties can be controlled.
7. Impedance matching in the signal bandwidth can be improved or implemented with a smaller footprint using the filtering function for impedance conversion.
8. Filter/antenna combinations should exhibit small delay variations between individuals in their signal paths, when mounted in their array positions.

Out of band radiation requirements apply one more system-level limitation that translates into the need for a frequency filtering function to be incorporated.

The inventors have realized that the majority of commonly used antenna types are not suitable for achieving the properties listed above. Each commonly used antenna type exhibits its own disadvantage. For example, patch antennas exhibit low rejection capability and moderate cross-polarization level. Inter-cardinal polarization isolation usually measures about 16-20 dB on-boresight in patch antennas. Horn antennas become bulky in frequency bands around 6 GHz or lower, and need a separate orthomode transducer or polarizer, which give rise to high production costs. Demanding requirements for cost efficiency and manufacturability requires the use of printed antenna elements compatible with printed circuit board (PCB) technology. The need for compatibility with complementary metal oxide semiconductor (CMOS) technology introduces one more requirement, i.e. the need to have a differential feeding system instead of a traditional single-ended coaxial or microstrip input. Unfortunately, traditional PCB-based MIMO antenna array elements are limited in terms of frequency selectivity available from the antenna element. Patches can be combined with slots to produce filter-like behavior, but with limited values of the quality factor (Q factor). The inventors have the idea of incorporating filtering in the antenna element. This is advantageous as the antenna elements have more space in the array than other components will have.

In traditional base station designs, the filters are incorporated as separate elements, but since each antenna element is now provided with separate active element control in the array (for the necessary flexibility of the lobe forming described above) it also needs dedicated filters, but traditional filters cannot be fitted due to space restrictions. Also, dual polarized beam-forming schemes require to double the number of filters making volume limitations even more pressing.

According to a first aspect of the present disclosure an antenna arrangement is provided comprising an electrical conductor extending along an axis, a first electrically conductive disc in contact with the electrical conductor and extending perpendicularly from the axis, and a second electrically conductive disc in contact with the conductor and extending perpendicularly from the axis. The antenna arrangement also comprises an electrically conductive housing enclosing, circumferentially around the axis, the electrical conductor, the first electrically conductive disc and the second electrically conductive disc. The antenna arrangement also comprises feeding means configured to feed electromagnetic energy to the first electrically conductive disc, transmitting means configured to transmit electromagnetic energy from the second electrically conductive disc, and a third electrically conductive disc in contact with the conductor and extending perpendicularly from the axis between the first electrically conductive disc and the second electrically conductive disc at a distance therefrom, wherein the third electrically conductive disc comprises at least one opening.

With an antenna arrangement according to the first aspect the filter function will be narrowed due to the third electrically conductive disc. The antenna arrangement according to the first aspect introduces a way to control the frequency selectivity of the radiating antenna element and in the same time retain polarization properties of the radiating antenna. As a result the space occupied by the antenna elements may also be used for frequency filtering. The antenna arrangement according to the first aspect also increases the inter-element isolation reducing the load pulling effect in antenna arrays during scanning.

Suitable antenna configurations have to be selected to satisfy the following requirements simultaneously.

The antenna arrangements may be used as an antenna element in an antenna array. The antenna arrangement should have a small cross section compatible with MIMO array element requirements and provide dual polarized operation with sufficient polarization orthogonality. The antenna arrangement may be arranged for a differential feeding system. It is advantageous if the antenna arrangement offers both single-ended and differential feeding architecture.

In a first possible implementation form of an antenna arrangement according to the first aspect at least one of the first electrically conductive disc and the second electrically conductive disc is symmetrical around the axis. Preferably, they are both symmetrical around the axis. By having the first electrically conductive disc and the second electrically conductive disc symmetrical around the axis dual polarized operation is improved.

In a second possible implementation form of an antenna arrangement according to the first possible implementation form or to the first aspect as such, the order of axial symmetry of at least one of the first electrically conductive disc and the second electrically conductive disc around the axis is an integer multiplied by a factor of four. By having such a symmetry on the first electrically conductive disc and the second electrically conductive disc the inter-cardinal polarization isolation may be improved.

In a third possible implementation form of an antenna arrangement according to the first or second possible implementation forms or to the first aspect as such, the electrically conductive housing comprises a first end wall enclosing the electrical conductor axially on the side of the first electrically conductive disc. By having a first end wall the transmission of radiation from the antenna arrangement may be controlled in a better way.

In a fourth possible implementation form of an antenna arrangement according to the third possible implementation form, the feeding means comprises feeding probes configured in proximity to the first electrically conductive disc and extending through the first end wall, wherein the feeding probes are configured to capacitively feed electromagnetic energy to the first electrically conductive disc. Thus, in this context proximity means that the feeding probes are sufficiently close to the first electrically conductive disc to enable capacitively feeding of electromagnetic energy to the first electrically conductive disc. Feeding electromagnetic energy to the first electrically conductive disc capacitively is an efficient way of feeding the electromagnetic energy.

In a fifth possible implementation form of an antenna arrangement according to the fourth possible implementation form, the feeding probes are configured symmetrically around the axis. By configuring the feeding probes symmetrically around the axis dual polarized operation is improved.

In a sixth possible implementation form of an antenna arrangement according to the fifth possible implementation form, the number of feeding probes is an integer multiplied by a factor of four. By having the feeding probes configured in this way dual polarized operation is optimized.

In a seventh possible implementation form of antenna arrangement according to the third possible implementation form, the feeding means comprises electrically conductive loops configured between the first electrically conductive disc and the third electrically conductive disc, wherein the electrically conductive loops are configured to inductively feed electromagnetic energy to the first electrically conductive disc. This is a favorable way of feeding electromagnetic energy to the first electrically conductive disc for a printed implementation of the antenna arrangement. Capacitive probes may not be the best option for a printed implementation of the antenna arrangement thin discs having a thickness of about 15 um-1 mm. Also, the arrangement of magnetic coupling loops provides a wider range of possible impedances of the feeding means. This helps matching to non-standard impedances. An important benefit is the possibility of differential feeding. An additional benefit is the possibility to realize power combining. Thus, the antenna arrangement can combine power from 8 sources via 4 differential pairs.

In an eighth possible implementation form of an antenna arrangement according to the seventh possible implementation form each electrically conductive loop comprises two feed points, wherein the first electrically conductive disc comprises slots extending from the periphery of the first electrically conductive disc, and wherein the feed points for each electrically conductive loop are configured on separate sides of the slots. The slots make sure that only a desired transmission mode can exist.

In a ninth possible implementation form of an antenna arrangement according to the seventh or eighth possible implementation forms, the electrically conductive loops are configured symmetrically around the axis. The symmetrical configuration of the electrically conductive loops provides for good isolation between the polarization directions of the transmitted electromagnetic radiation, and makes sure only a desired transmission mode can exist.

In a tenth possible implementation form of an antenna arrangement according to the seventh, eighth or ninth possible implementation forms, the antenna arrangement further comprises a first dielectric layer configured between the first electrically conductive disc and the electrically conductive loops, a second dielectric layer configured between the electrically conductive loops and the third electrically conductive disc, and a third dielectric layer configured between the third electrically conductive disc and the second electrically conductive disc. The dielectric layers provide mechanical rigidity to a printed implementation of the antenna arrangement in which the first electrically conductive disc, the second electrically conductive disc and the third electrically conductive disc are thin and close to each other. The dielectric layers can be manufactured from any suitable dielectric material such as, e.g., an epoxy compound, a ceramic, aluminium dioxide, or FR-4. FR-4 (also designated FR4), is a grade designation assigned to glass-reinforced epoxy laminate sheets, tubes, rods and printed circuit boards (PCB). FR-4 is a composite material composed of woven fiberglass cloth with an epoxy resin binder that is flame resistant. FR stands for flame retardant.

In an eleventh possible implementation form of an antenna arrangement according to any of the first to the tenth possible implementation forms or to the first aspect as such, the electrically conductive housing comprises a second end wall enclosing the conductor axially on the side of the second electrically conductive disc. Such a second end wall enables an increased controllability of the electromagnetic radiation from the antenna arrangement.

In a twelfth possible implementation form of an antenna arrangement according to the eleventh possible implementation form, the transmitting means comprises radiating elements in electrical contact with the second electrically conductive disc and extending through the second end wall. By having such radiating elements the efficiency of the transmitting means may be greatly improved.

In a thirteenth possible implementation form of an antenna arrangement according to the twelfth possible implementation form, the radiating elements are configured symmetrically around the axis. The symmetrical configuration of the electrically conductive loops provides for good isolation between the polarization directions of the transmitted electromagnetic radiation, and makes sure only a desired transmission mode can exist.

In a fourteenth possible implementation form of an antenna arrangement according to the thirteenth possible implementation form, the number of radiating elements is an integer multiplied by a factor of four. By having such a symmetry on the first electrically conductive disc and the second electrically conductive disc the inter-cardinal polarization isolation may be improved.

In a fifteenth possible implementation form of an antenna arrangement according to any of the first to the fourteenth possible implementation form, the order of axial symmetry of the third electrically conductive disc around the axis is an integer multiplied by a factor of four. If expressed in terms of the order of axial symmetry used in crystallography, the following suitable orders of symmetry exist:

$C_4, C_8, C_{16}, \ldots C_\infty$

In the first extreme denoted $C_4$ the order of axial symmetry is 4. Thus, the antenna aperture may be rotated into four different positions around the symmetry axis corresponding to a square shape. In the other extreme the antenna aperture has a circular shape.

Below a description of embodiments will follow. In the following description of embodiments of the disclosure the same reference numerals will be used for the same features in the different drawings.

SHORT DESCRIPTION OF DRAWINGS

DETAILED DESCRIPTION

Figure 1A:
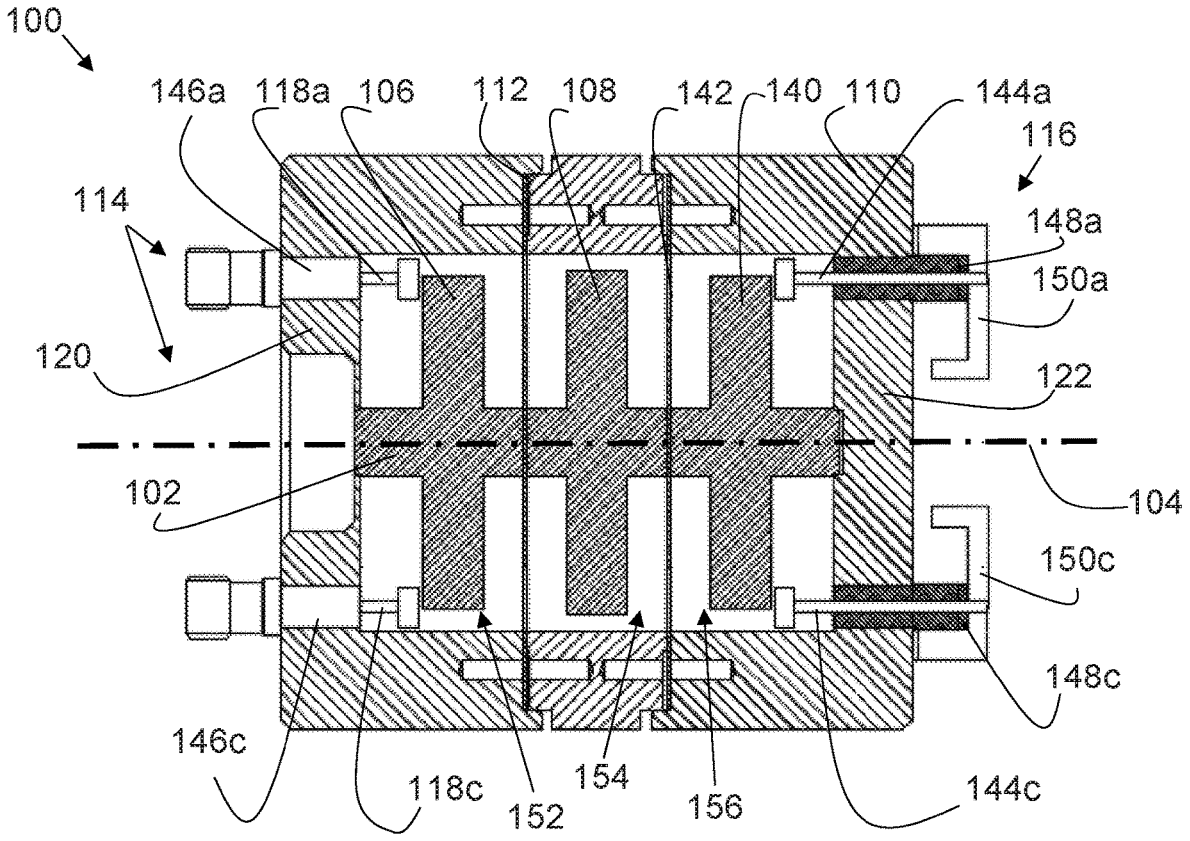
FIG. 1A shows schematically in cross section a side view of an antenna arrangement according to an embodiment.

In the following description embodiments of the disclosure the same reference numerals will be used for the same features in the different drawings.

Figure 1B:
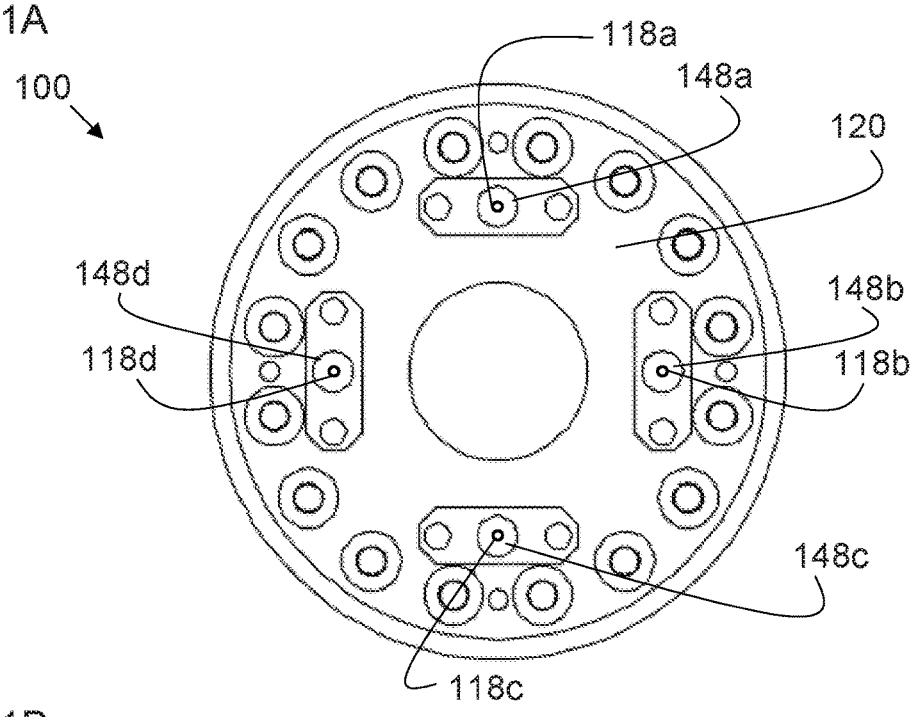
FIG. 1B shows schematically an end of the antenna arrangement in FIG. 1A.
Figure 1C:
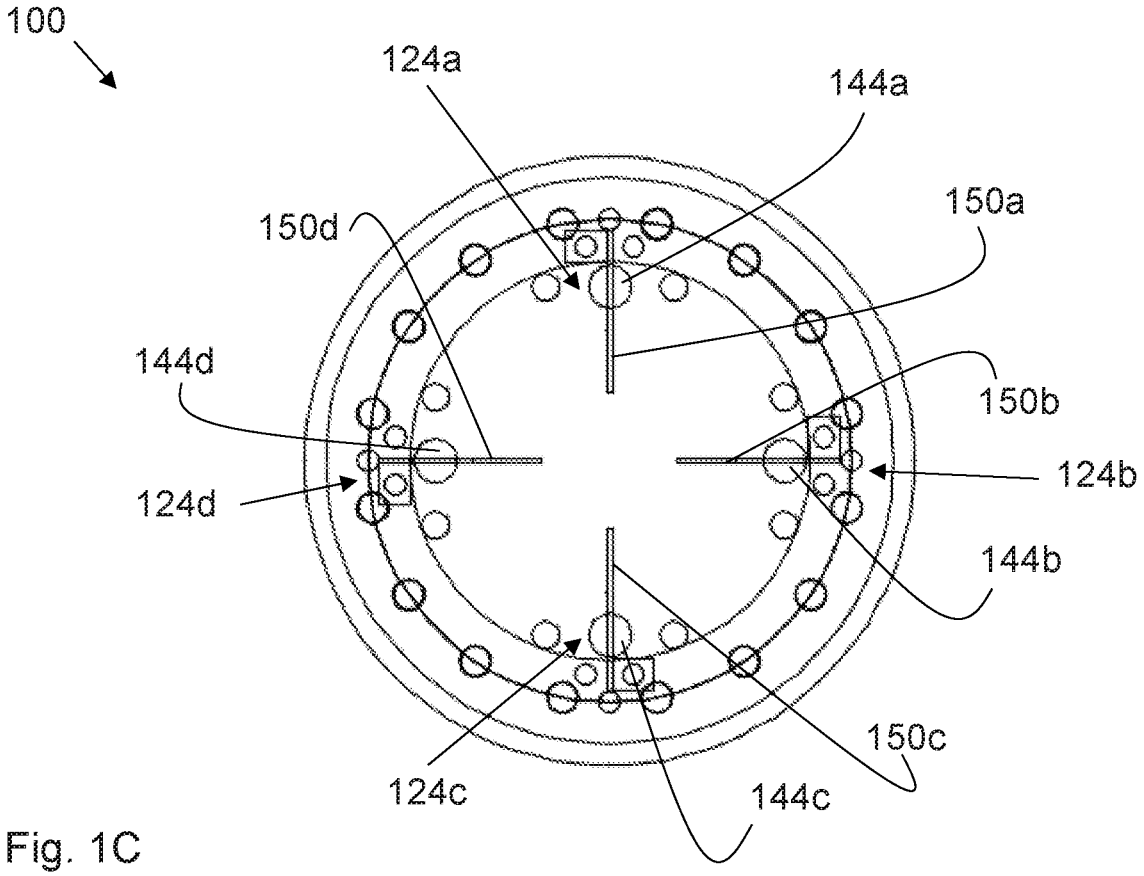
FIG. 1C shows schematically the end of the antenna arrangement in FIG. 1A being opposite to the end in FIG. 1B.
Figure 1D:
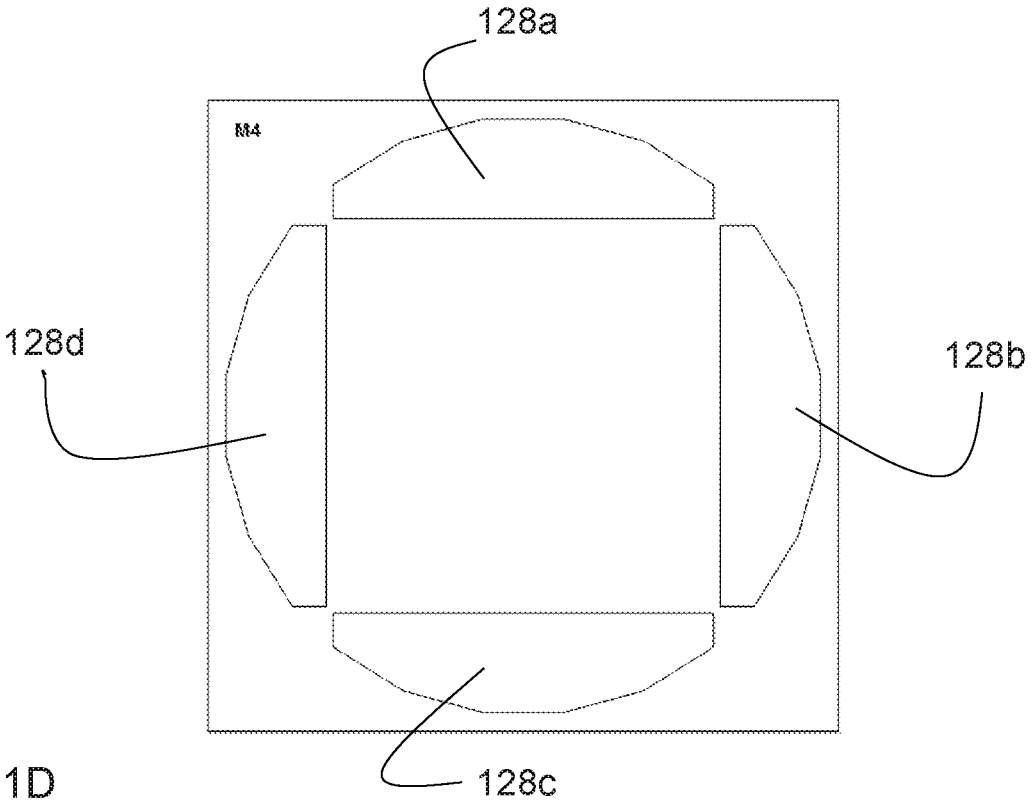
FIG. 1D shows the third and fifth electrically conductive discs in the antenna arrangement in FIG. 1A.

FIG. 1A shows schematically in cross section a side view of an antenna arrangement 100 according to an embodiment. FIG. 1B shows schematically an end of the antenna arrangement in FIG. 1A. FIG. 1C shows schematically the end of the antenna arrangement in FIG. 1A being opposite to the end shown in FIG. 1B. FIG. 1D shows the shape of the third electrically conductive disc 112 and the fifth electrically conductive disc 142 in the antenna arrangement in FIG. 1A. The antenna arrangement 100 comprises an electrical conductor 102 extending along an axis 104, a first electrically conductive disc 106 in contact with the electrical conductor 102 and extending perpendicularly from the axis 104. The antenna arrangement 100 also comprises a second electrically conductive disc 108 in contact with the conductor 102 and extending perpendicularly from the axis 104. The antenna arrangement also comprises an electrically conductive housing 110 enclosing, circumferentially around the axis 104, the electrical conductor 102, the first electrically conductive disc 106, and the second electrically conductive disc 108. The antenna arrangement 100 also comprises a third electrically conductive disc 112 in contact with the conductor 102 and extending perpendicularly from the axis 104 between the first electrically conductive disc 106 and the second electrically conductive disc 108 at a distance therefrom. The antenna arrangement also comprises feeding element(s) or feeding means 114 configured to feed electromagnetic energy to the first electrically conductive disc 106. In FIG. 1A the feeding element(s) are in the form of a first feeding probe 118*a*, a second feeding probe 118*b* (see FIG. 1B), a third feeding probe 118*c*, and a fourth feeding probe 118*d* (see FIG. 1B), configured in proximity to the first electrically conductive disc 106 and extending through the first end wall 120. The first feeding probe 118*a*, the second feeding probe 118*b*, the third feeding probe 118*c*, and the fourth feeding probe 118*d*, are configured to capacitively feed electromagnetic energy to the first electrically conductive disc 106. As can be seen in FIG. 1A-FIG. 1C the first feeding probe 118*a*, the second feeding probe 118*b*, the third feeding probe 118*c*, and the fourth feeding probe 118*d*, are configured symmetrically around the axis 104. Furthermore, the antenna arrangement in FIG. 1A comprises an optional fourth electrically conductive disc 140 in contact with the conductor 102 and extending perpendicularly from the axis 104 and an optional fifth electrically conductive disc 142, in contact with the conductor 102 and extending perpendicularly from the axis 104 between the second electrically conductive disc 108 and the optional fourth electrically conductive disc 140 at a distance therefrom. The antenna arrangement 100 also comprises transmitting element(s) or transmitting means 116 configured to transmit electromagnetic energy from the optional fourth electrically conductive disc 140. The third electrically conductive disc 112 and the fifth electrically conductive disc 142 both have the same shape and comprise four non-conductive openings 128*a*, 128*b*, 128*c*, 128*d* as is shown in FIG. 1D. The antenna arrangement comprises transmitting means (not shown in FIG. 1A) configured to transmit electromagnetic energy from the second electrically conductive disc 108. The transmitting element 116 comprises a first radiating element 124*a*, a second radiating element 124*b*, a third radiating element 124*c*, and a fourth radiating element 124*d* (see FIG. 1C).

The first electrically conductive disc 106 and the second electrically conductive disc 108 are both symmetrical around the axis 104. In the shown embodiment, the first electrically conductive disc 106 and the second electrically conductive disc 108 are circular but they could have other shapes. The order of axial symmetry of at least one of the first electrically conductive disc 106 and the second electrically conductive disc 108 around the axis 104 should be an integer multiplied by a factor of four.

The electrically conductive housing 110 comprises a first end wall 120 enclosing the electrical conductor 102 axially on the side of the first electrically conductive disc 106. The feeding probes 118*a*, 118*b*, 118*c*, 118*d*, are configured in proximity to the first electrically conductive disc 106 and extend through the first end wall 120 with spacers 146*a*, 146*b*, 146*c*, 146*d*, between the respective feeding probes 118*a*, 118*b*, 118*c*, 118*d*, and the first end wall 120.

The electrically conductive housing 110 also comprises a second end wall 122 enclosing the conductor 102 axially on the side of the second electrically conductive disc 108.

The first radiating element 124*a*, the second radiating element 124*b*, the third radiating element 124*c*, and the fourth radiating element 124*d*, are configured in proximity to the fourth electrically conductive disc 140 and extends through the second end wall 122. Electromagnetic energy is coupled capacitively from the fourth electrically conductive disc 140 to the first radiating element 124*a*, the second radiating element 124*b*, the third radiating element 124*c*, and the fourth radiating element 124*d*. The first radiating element 124*a* comprises a first radiating probe 144*a* and a first patterned etched loop 150*a*, and is secured in the second end wall 122 by means of a first Teflon holder 148*a*. The second radiating element 124*b* comprises a second radiating probe 144*b* and a second patterned etched loop 150*b*, and is secured in the second end wall 122 by means of a second Teflon holder 148*b*. The third radiating element 124*a* comprises a third radiating probe 144*c* and a third patterned etched loop 150*c*, and is secured in the second end wall 122 by means of a third Teflon holder 148*c*. The fourth radiating element 124*d* comprises a fourth radiating probe 144*d* and a fourth patterned etched loop 150*d*, and is secured in the second end wall 122 by means of a fourth Teflon holder 148*d*. The radiating elements 124*a*, 124*b*, 124*c*, 124*d*, are configured symmetrically around the axis 104.

As mentioned above, FIG. 1D shows the shape of the third electrically conductive disc 112 and the fifth electrically conductive disc 142 which are both in the form of so-called irises. The third electrically conductive disc 112 and the fifth electrically conductive disc 142 comprise a first opening 128*a*, a second opening 128*b*, a third opening 128*c*, and a fourth opening 128*d*. The antenna arrangement forms a first cavity 152, between the first end wall 120 and the third electrically conductive disc 112, a second cavity 154, between the third electrically conductive disc 112 and the fifth electrically conductive disc 142, and a third cavity 156 between the fifth electrically conductive disc 142 and the second end wall 122. Each cavity 152, 154, 156, supports two orthogonal linearly polarized modes. The electromagnetic coupling between the cavities is controlled by the openings 128*a*, 128*b*, 128*c*, 128*d*, in the third electrically conductive disc 112 and the fifth electrically conductive disc 142. The first opening 128*a* and the third opening 128*c*, form a first pair of openings. The second opening 128*b* and the fourth opening 128*d* form a second pair of openings. The openings 128*a*, 128*b*, 128*c*, 128*d*, are configured symmetrically to ensure no coupling between orthogonal modes.

Apart from cylindrical Teflon holders 148*a*, 148*b*, 148*c*, 148*d*, the radiating elements use no lossy dielectrics and are etched out of rolled copper sheet, which makes them practically lossless. Matching is achieved by geometry optimization. Return Loss is better than 20 dB within 100 MHz pass-band.

In operation electromagnetic energy is fed capacitively by means of the feeding probes 118*a*, 118*b*, 118*c*, 118*d*, to the first electrically conductive disc 106. A first pair of feeding probes in the form of the first feeding probe 118*a* and the third feeding probe 118*c* feed electromagnetic energy to a first mode. A second pair of feeding probes in the form of the second feeding probe 118*b* and the fourth feeding probe 118*d* feed electromagnetic energy to a second mode which is orthogonal to the first mode. The electromagnetic energy is transmitted and filtered through the antenna arrangement and output via the first radiating element 124*a*, the second radiating element 124*b*, the third radiating element 124*c*, and the fourth radiating element 124*d*. The first radiating element 124*a* and the second radiating element 124*b*, are arranged in a pair to transmit a first mode while the third radiating element 124*c*, and the fourth radiating element 124*d*, are arranged in a second pair to transmit a second mode being orthogonal to the first mode.

Figure 2A:
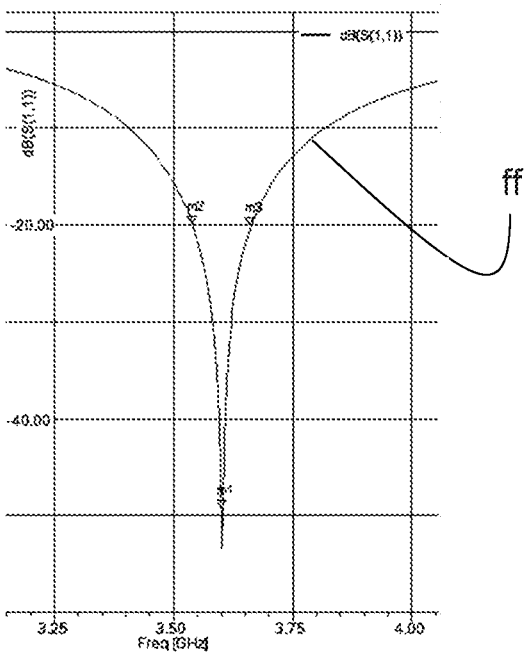
FIG. 2A is a diagram showing the return loss of the radiating element in FIG. 1A. as a function of the frequency.
Figure 2B:
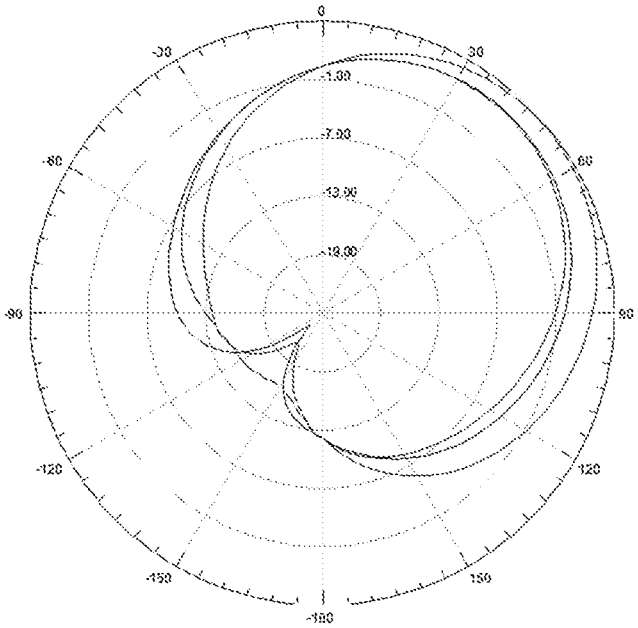
FIG. 2B shows schematically the radiation pattern of the radiating element in FIG. 1A.

FIG. 2A is a diagram showing the return loss of one of the radiating elements 124*a*, 124*b*, 124*c*, 124*d*, in FIG. 1A. as a function of the frequency. The return loss of the radiating elements 124*a*, 124*b*, 124*c*, 124*d*, shall be added to the return loss of the rest of the antenna arrangement. The return loss has a very sharp filter function ff which means that the antenna arrangement will transmit electromagnetic radiation in a very narrow band with a peak a 3.65 GHz. FIG. 2B shows schematically the radiation pattern of the radiating element in FIG. 1A for three different phases. FIG. 2B shows that the radiation pattern is close to isotropic (or "half sphere"), which was listed as desirable in the summary above.

Figure 3A:
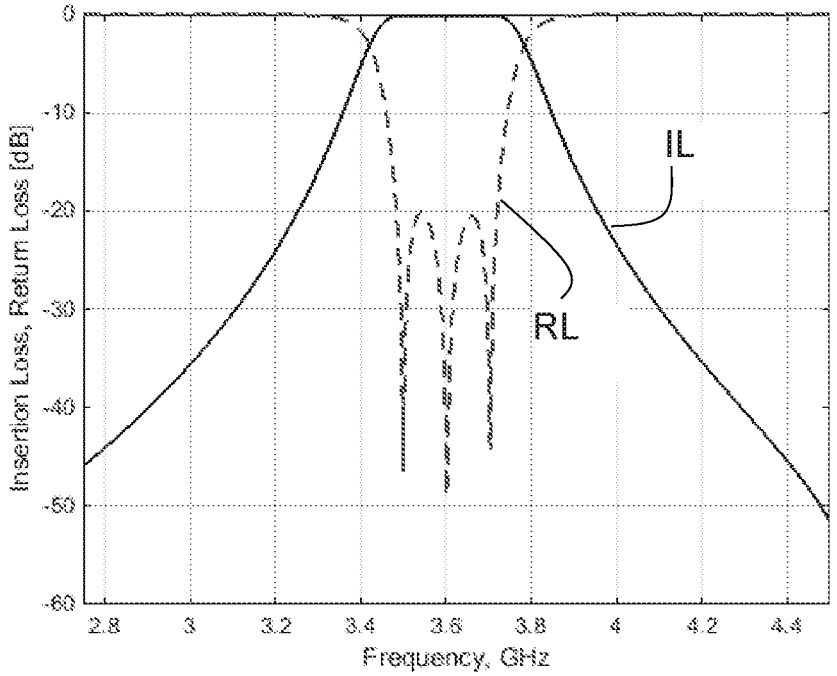
FIG. 3A is a diagram showing the insertion loss and the return loss for the antenna arrangement in FIG. 1A.
Figure 3B:
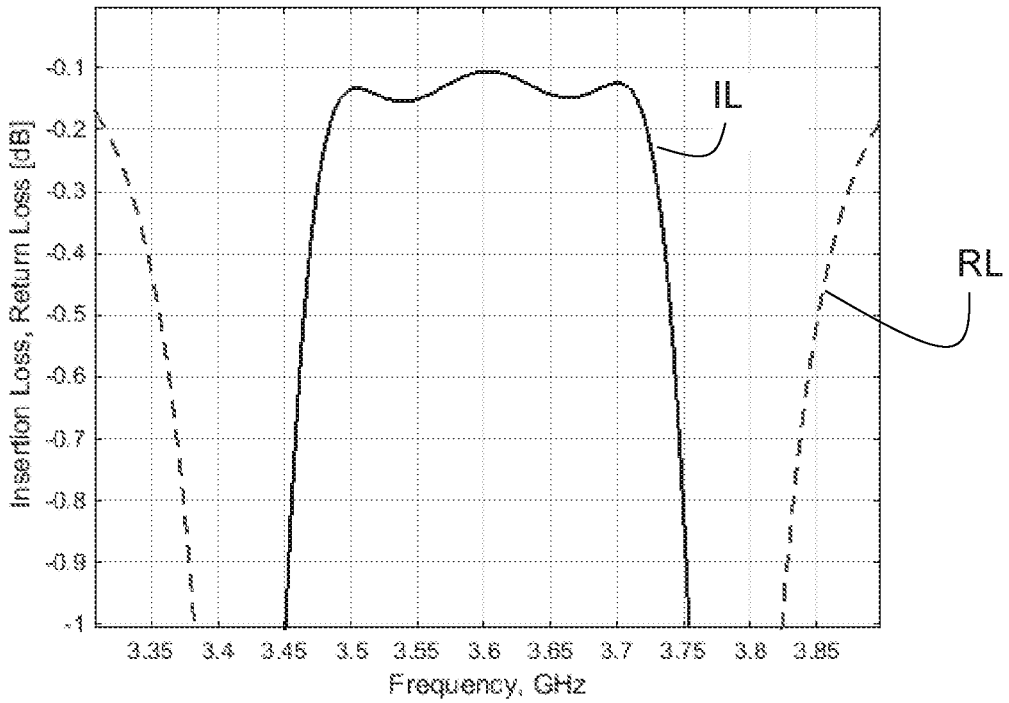
FIG. 3B shows in larger detail a part of the curves in FIG. 3A.

FIG. 3A is a diagram showing the insertion loss and the return loss for the antenna arrangement in FIG. 1A. FIG. 3B shows in larger detail a part of the curves in FIG. 3A. Curve RL shows the return loss while curve IL shows the insertion loss. The return loss has a first peak at f1=3.5 GHz, a second peak at f2=3.6 GHz and a third peak at f3=3.7 GHz. The three peaks which are due to the fact that the antenna arrangement has a first electrically conductive disc 106, a second electrically conductive disc 108, and a fourth electrically conductive disc 140. These discs are usually called corrugations in filters according to earlier technology. The third electrically conductive disc 112 and the fifth electrically conductive disc are called irises and comprises openings.

Figure 4:
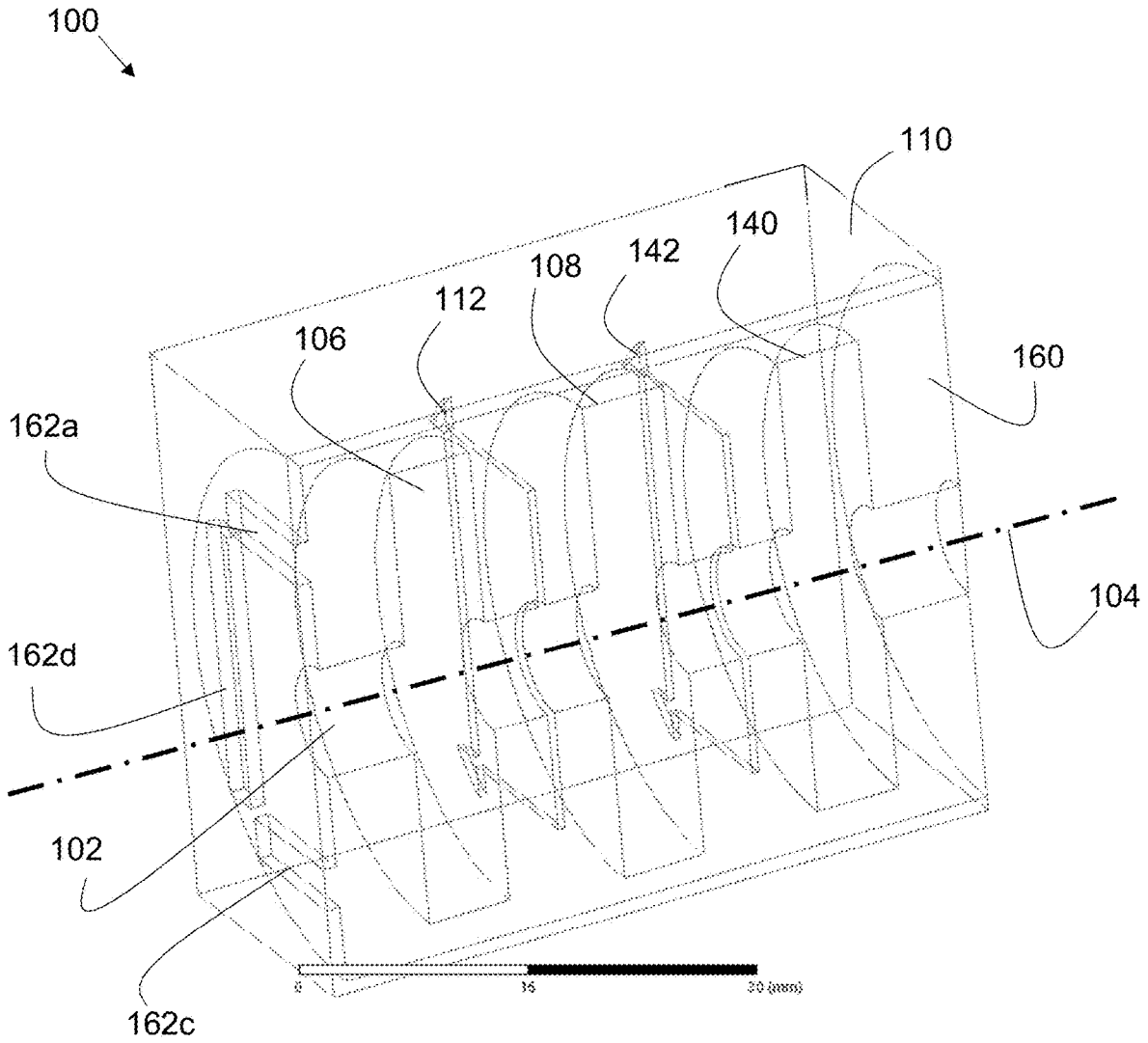
FIG. 4 is a perspective cross sectional view of another embodiment of an antenna arrangement which is similar to the antenna arrangement in FIG. 1A.

FIG. 4 is a perspective cross sectional view of another embodiment of an antenna arrangement which is similar to the antenna arrangement in FIG. 1A. The same reference numerals will be used for similar features in FIG. 4 and FIG. 1A. The antenna arrangement 100 comprises an electrical conductor 102 extending along an axis 104, a first electrically conductive disc 106 in contact with the electrical conductor 102 and extending perpendicularly from the axis 104. The antenna arrangement 100 also comprises a second electrically conductive disc 108 in contact with the conductor 102 and extending perpendicularly from the axis 104. The antenna arrangement also comprises an electrically conductive housing 110 enclosing, circumferentially around the axis 104, the electrical conductor 102, the first electrically conductive disc 106, and the second electrically conductive disc 108. The antenna arrangement 100 also comprises a third electrically conductive disc 112 in contact with the conductor 102 and extending perpendicularly from the axis 104 between the first electrically conductive disc 106 and the second electrically conductive disc 108 at a distance therefrom. The antenna arrangement also comprises feeding means 114 (See, FIG. 1A) configured to feed electromagnetic energy to the first electrically conductive disc 106. The main differences between the antenna arrangement in FIG. 1A and the antenna arrangement in FIG. 4 is that the antenna arrangement in FIG. 4 lacks sidewalls and separate radiating elements. Thus, the transmitting means in the antenna arrangement shown in FIG. 4 is an opening which is marked with the field 160. Also the feeding means 114 is different and comprises an electrically conductive disc with a first feeding aperture 162*a*, a second feeding aperture (not shown in FIG. 4), a third feeding aperture 162*c*, and a fourth feeding aperture 162*d*.

Figure 5:
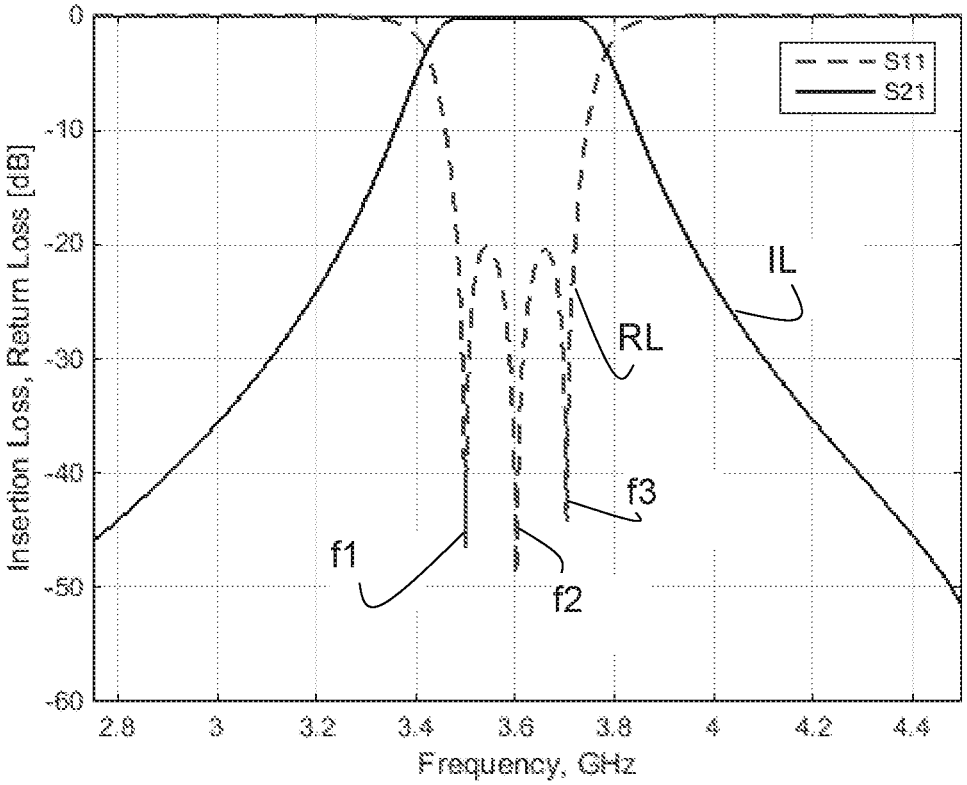
FIG. 5 is a diagram showing the insertion loss and the return loss of the radiating element of FIG. 4.
Figure 6A:
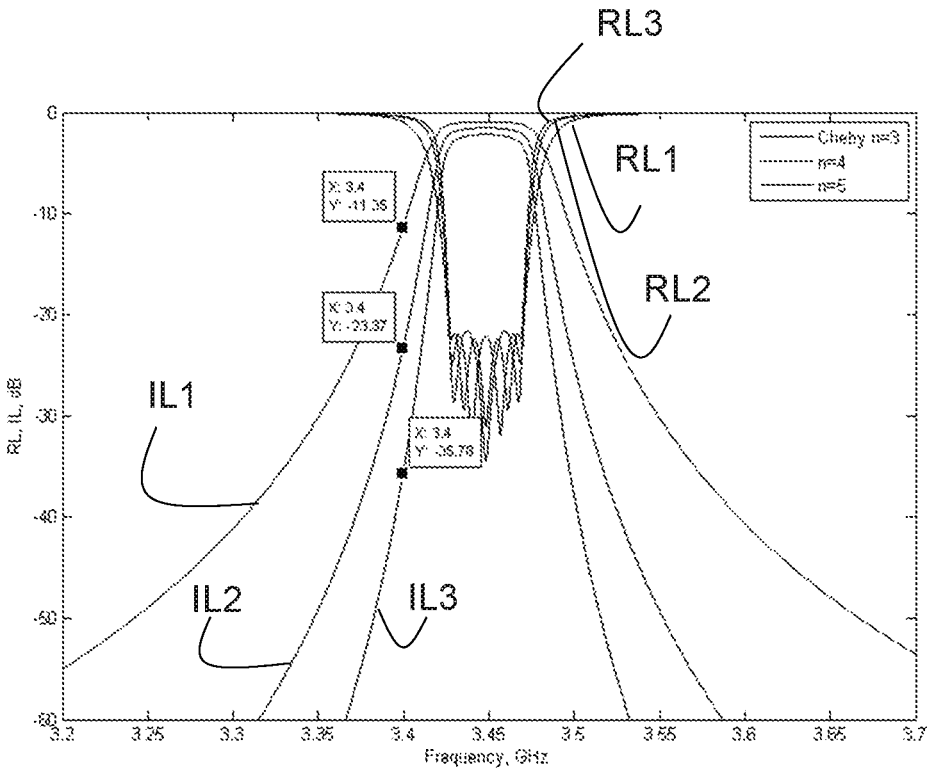
FIG. 6A is a diagram showing examples of the insertion loss and the return loss for radiating elements with different numbers of electrically conductive disc.
Figure 6B:
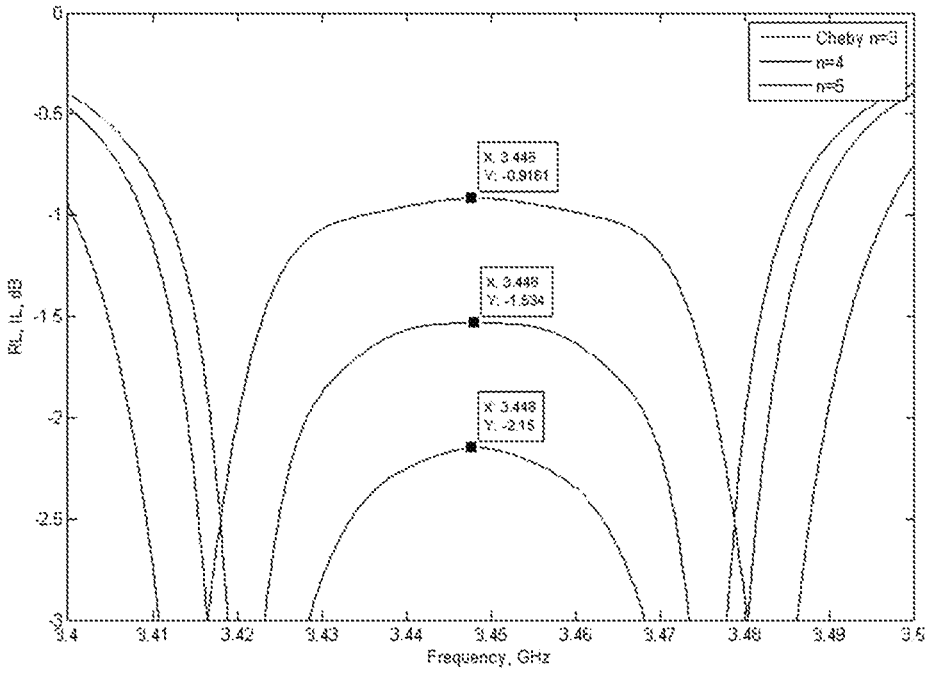
FIG. 6B shows in larger detail a part of the diagram in FIG. 6A.

FIG. 5 is a diagram showing the insertion loss and the return loss of the radiating element of FIG. 4 as a function of the frequency. The return loss is shown by the curve RL while the insertion loss is shown by the curve IL. Similar to FIG. 3 the return loss has a first peak at f1=3.5 GHz, a second peak at f2=3.6 GHz and a third peak at f3=3.7 GHz FIG. 6A is a diagram showing examples of the insertion loss and the return loss for radiating elements with different numbers of electrically conductive disc. The first return loss curve RL1 shows the return loss for an antenna arrangement with three electrically conductive discs. The second return loss curve RL2 shows the return loss for an antenna arrangement with four electrically conductive discs. The third return loss curve RL3 shows the return loss for an antenna arrangement with five electrically conductive discs. Even if it is not very clear from FIG. 6A the first return loss curve RL1 has three peaks, the second return loss curve RL2 has four peaks and the third return loss curve RL3 has five peaks. The first insertion loss curve IL1 shows the insertion loss for an antenna arrangement with three electrically conductive discs. The second insertion loss curve IL2 shows the insertion loss for an antenna arrangement with four electrically conductive discs. The third insertion loss curve RL3 shows the insertion loss for an antenna arrangement with five electrically conductive discs. As can be seen the insertion loss curves becomes more narrow with more electrically conductive discs. FIG. 6B shows in larger detail a part of the diagram in FIG. 6A.

Figure 7:
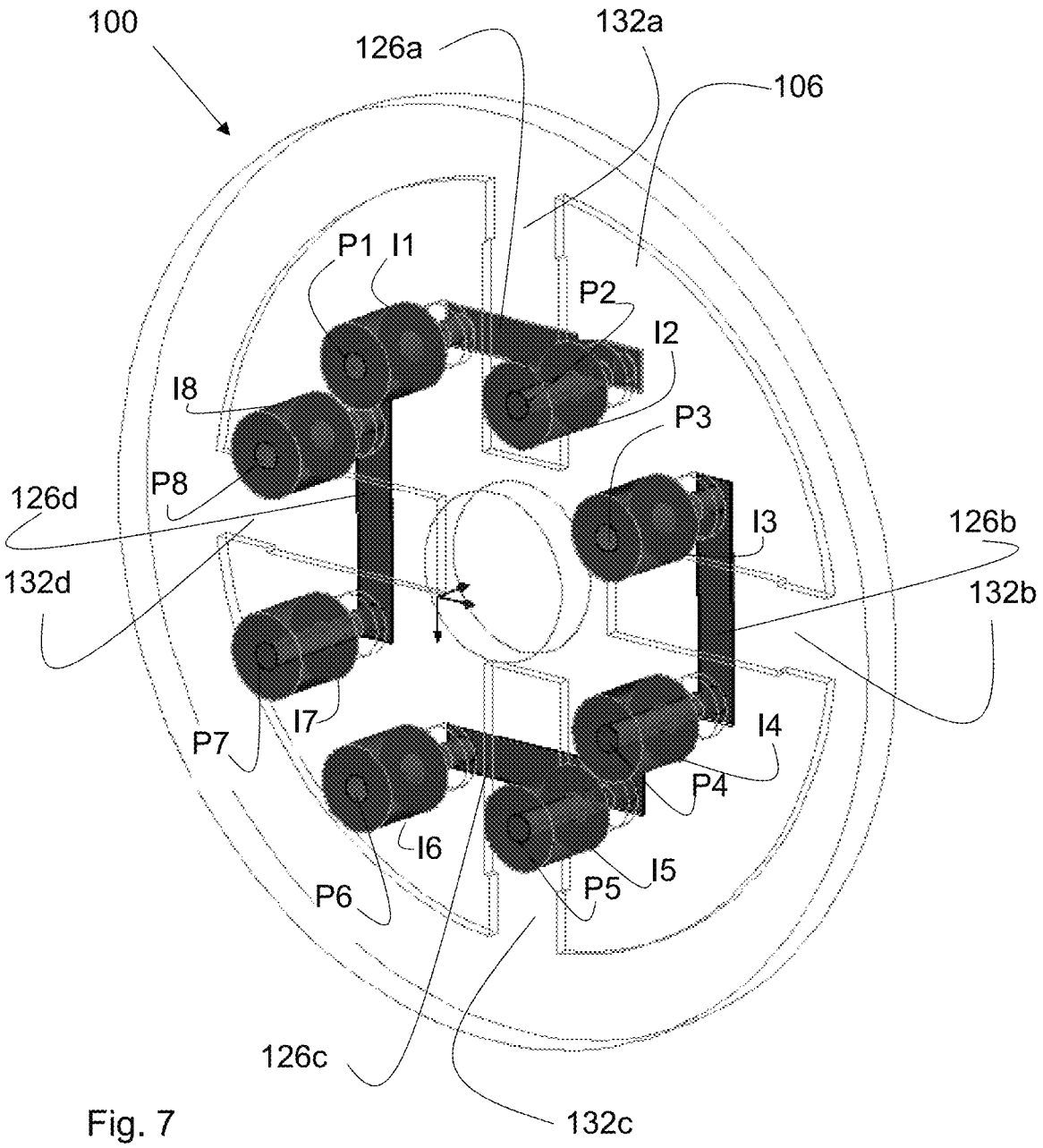
FIG. 7 shows an antenna arrangement according to another embodiment.

FIG. 7 shows an antenna arrangement according to another embodiment. For low power, mass produced antenna arrangements the cost is an important design driver. This motivates the efforts to manufacture a printed implementation of an antenna arrangement. Capacitive probes may not be the best option for printed implementation due to added cost. A printed antenna arrangement may be manufactured at a low cost and will also benefit from the possibility to incorporate power combining stages in the antenna arrangement. This can be implemented by way the first cavity is fed. The feeding arrangement based on a planar perforated resonator is advantageous. It is designed based on two pairs of differentially fed magnetic loops and a central ground point. This makes sure that only desired modes can exist. The antenna arrangement shown in FIG. 7 comprises a first port P1, a second port P2, a third port P3, a third port P4, a fifth port P5, a sixth port P6, a seventh port P7, and an eighth port P8. The first electrically conductive disc 106 comprises a first slot 132*a*, a second slot 132*b*, a third slot 132*c* and a fourth slot 132*d*. All slots extend from the periphery of the first electrically conductive disc The first slot 132*a* and the opposing third slot 132*c* form a first pair of slots for a first polarization direction. The second slot 132*b* and the opposing fourth slot 132*d* form a second pair of slots for a second polarization direction. A first coaxial input port P1 and a second coaxial port P2 are configured on either side of the first slot 132*a* through the first electrically conductive wall 120 (not shown in FIG. 7). A first isolator I1 is configured between the first input port P1 and the first electrically conductive disc 106. A second isolator 12 is configured between the second input port P2 and the first electrically conductive wall 120. A third coaxial input port P3 and a fourth coaxial port P4 are configured on either side of the second slot 132*b* through the first electrically conductive wall 120. A third isolator 13 is configured between the third input port P3 and the first electrically conductive wall 120. A fourth isolator 14 is configured between the fourth input port P4 and the first electrically conductive wall 120. A fifth coaxial input port P5 and a sixth coaxial port P6 are configured on either side of the third slot 132*c* through the first electrically conductive disc 106. A fifth isolator 15 is configured between the fifth input port P5 and the first electrically conductive wall 120. A sixth isolator 16 is configured between the sixth input port P6 and the first electrically conductive wall 120. A seventh coaxial input port P7 and an eighth coaxial port P8 are configured on either side of the fourth slot 132*d* through the first electrically conductive wall 120. A seventh isolator 17 is configured between the seventh input port P7 and the first electrically conductive disc 106. An eighth isolator 18 is configured between the eighth input port P8 and the first electrically conductive wall 120.

A first electrically conductive loop 126*a* is connected between the first input port P1 and the second input port P2 to form a first differential pair. A second electrically conductive loop 126*b* is connected between the third input port P3 and the fourth input port P4 to form a second differential pair. A third electrically conductive loop 126*c* is connected between the fifth input port P5 and the sixth input port P6 to form a third differential pair. A fourth electrically conductive loop 126*d* is connected between the seventh input port P7 and the eighth input port P8 to form a fourth differential pair. The first differential pair P1-P2 and the third differential pair P5-P6 feed the horizontal polarization. The second differential pair P3-P4 and the fourth differential pair P7-P8 feed the vertical polarization.

Figure 8:
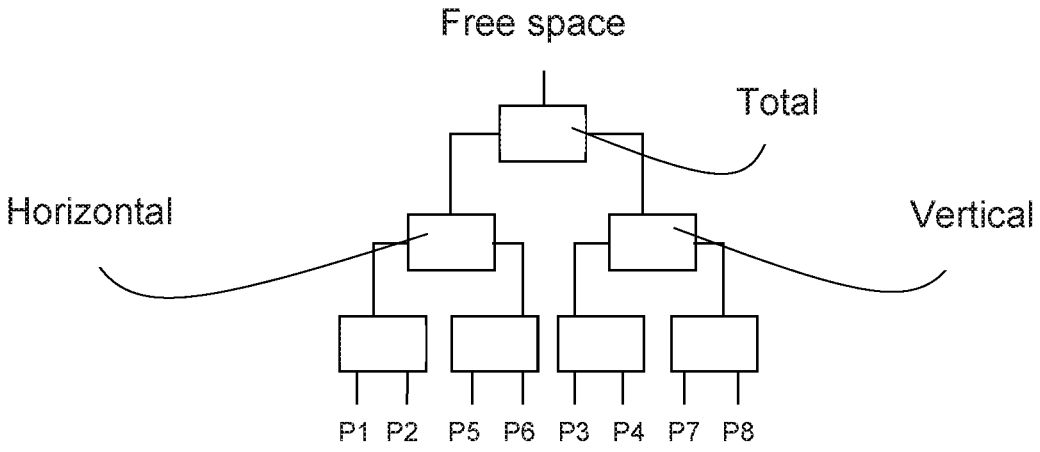
FIG. 8 illustrates how electromagnetic energy fed to the different feed points in the antenna arrangement in FIG. 7 is combined into a combined transmitted electromagnetic wave.

By configuring the first electrically conductive disc with a slot geometry, an additional degree of freedom useful to position the magnetic loops is provided. The slots also provide a wider range of possible impedances to present to the ports. This helps matching the ports to non-standard impedances like 50 Ohm differential, as opposed to a standard 100 Ohm differential. Another important feature is that differential feeding provides room for additional power combining steps. Thus, the antenna arrangement in FIG. 7 can combine power from 8 sources via 4 differential pairs. FIG. 8 illustrates how electromagnetic energy fed to the different feed points in the antenna arrangement in FIG. 7 is combined into a combined transmitted electromagnetic wave. In a first step the power from the ports in the differential pairs are combined. The power from the first port P1 is combined with the power from the second port P2 in the first electrically conductive loop 126*a*. The power from the fifth port P5 is combined with the power from the sixth port P6 in the third electrically conductive loop 126*b*. The power from the third port P3 is combined with the power from the fourth port P4 in the electrically conductive loop 126*b*. The power from the seventh port P7 is combined with the power from the eighth port P8 in the fourth electrically conductive loop 126*d*. The first electrically conductive loop 126*a* and the third electrically conductive loop 126*c* both feed the horizontal polarization direction, while the second electrically conductive loop 126*b* and the fourth electrically conductive loop 126*d* both feed the vertical polarization direction. In the second step the power from the first electrically conductive loop 126*a* is combined with the power from the third electrically conductive loop 126*c* into the horizontal polarization direction. Also, in the second step the power from the second electrically conductive loop 126*b* is combined with the power from the fourth electrically conductive loop 126*a* into the vertical polarization direction. Finally, in a third step the power from the horizontal polarization direction is combined with the power from the vertical polarization direction to create the total signal emitted from the antenna arrangement 100.

Figure 9A:
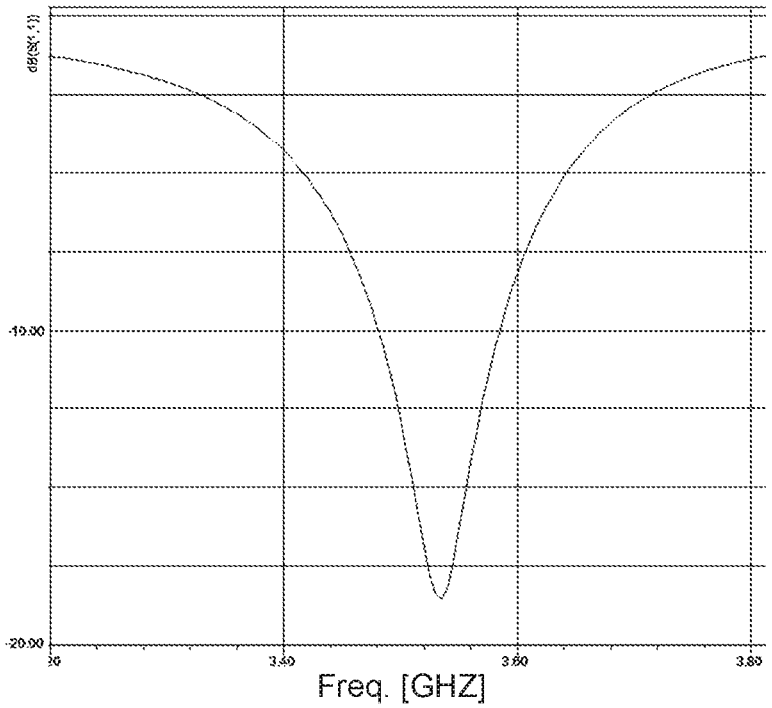
FIG. 9A shows the return loss for the radiating element in the antenna arrangement in FIG. 8.
Figure 9B:
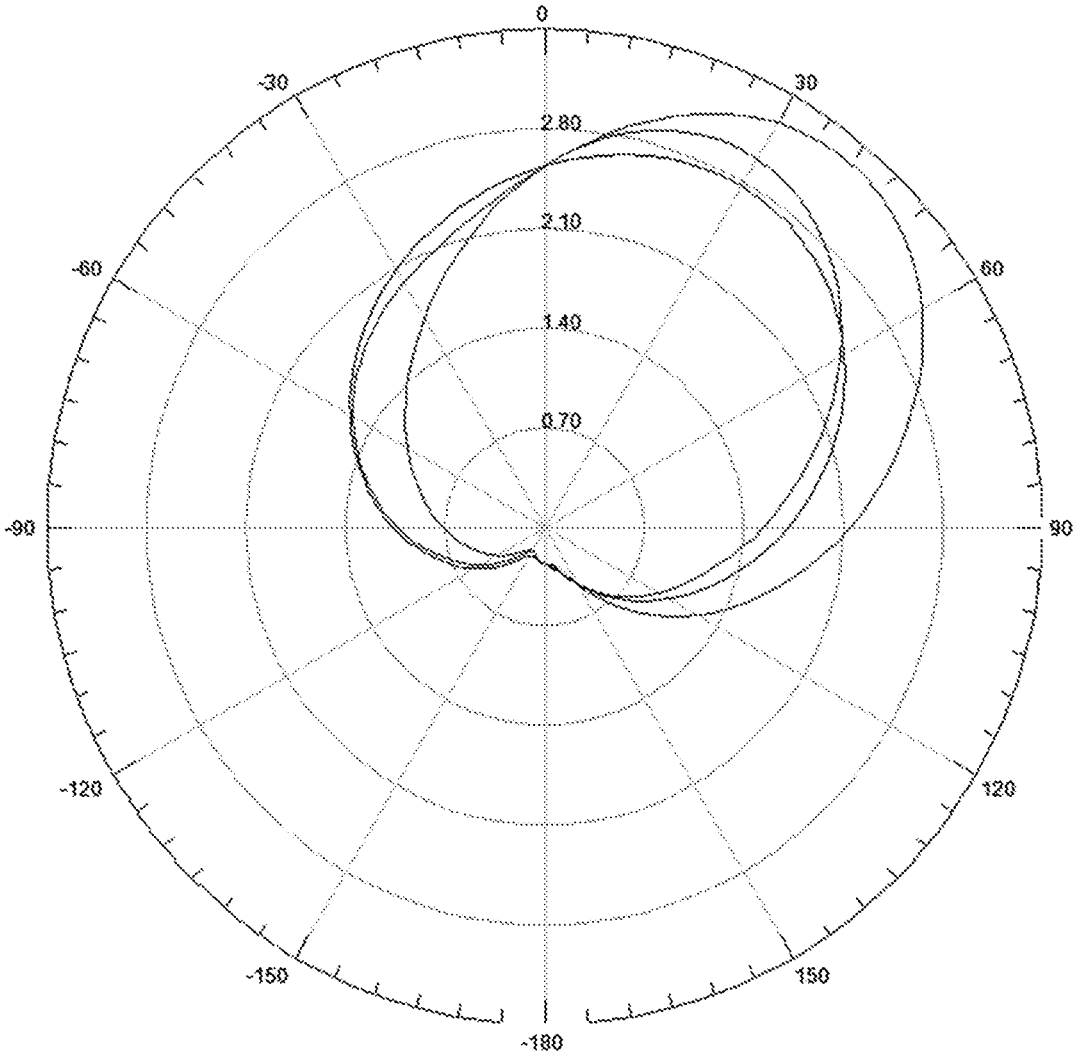
FIG. 9B shows the radiation pattern from the radiating element in the antenna arrangement in FIG. 8.

FIG. 9A shows the return loss for the radiating element in the antenna arrangement in FIG. 7. FIG. 9B shows the radiation pattern from the radiating element in the antenna arrangement in FIG. 8.

Figure 10:
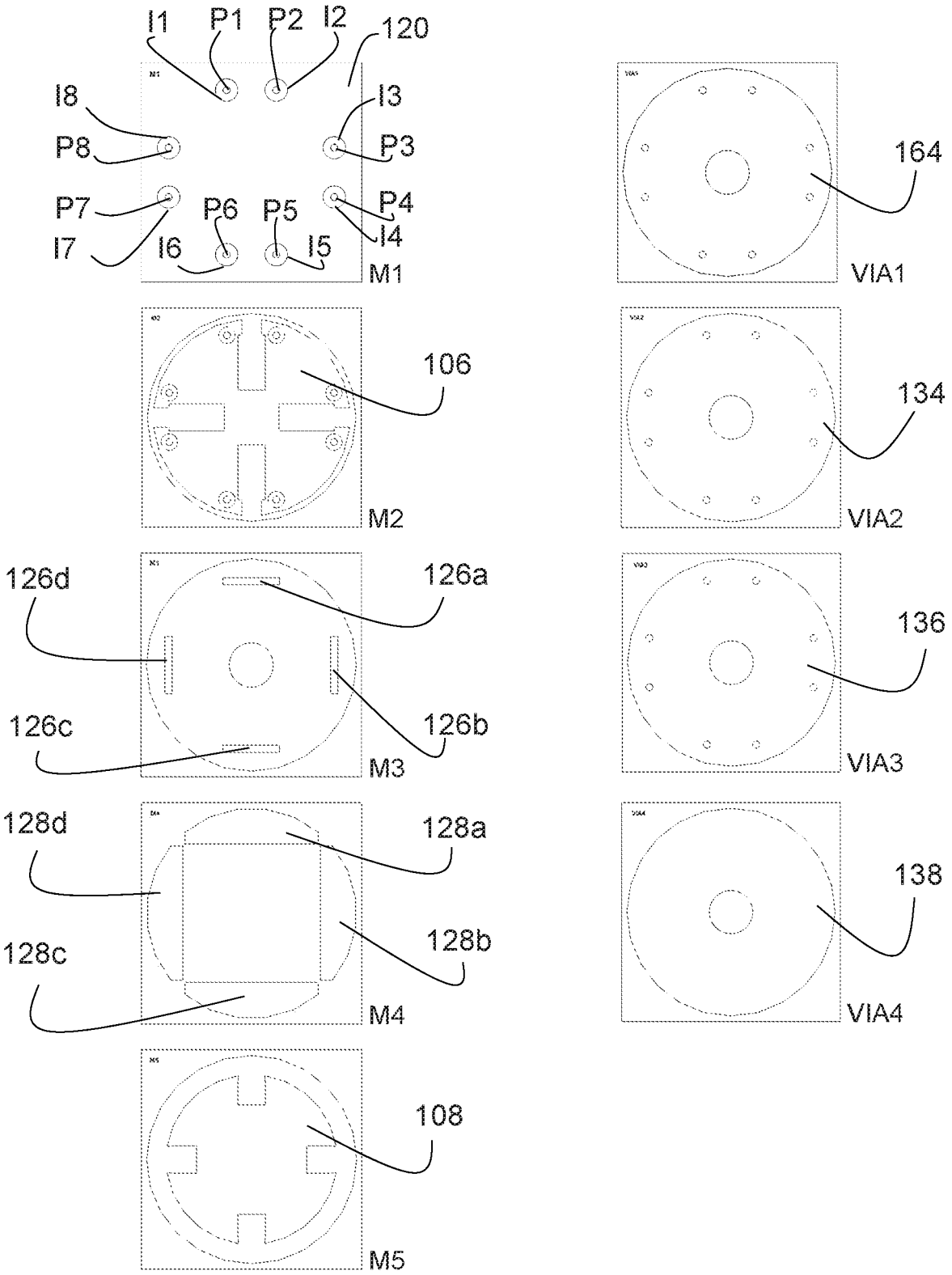
FIG. 10 shows the different layers in the antenna arrangement in FIG. 8.

FIG. 10 shows the different layers in the antenna arrangement in FIG. 7. The different layers shown in FIG. 10 are arranged in the following order: M1, VIA1, M2, VIA2, M3, VIA3, M4, VIA4, M5. The first electrically conductive disc is shown on M2. The electrically conductive loops 126*a*, 126*b*, 126*c*, 126*d* are shown on M3 and are configured between the first electrically conductive disc 106 and the third electrically conductive disc 112 which is shown on M4. The second electrically conductive disc 108 is shown on M5. The layers on VIA 1, VIA2, VIA3, and VIA4 are dielectric layers which provide spacer layers. A first dielectric layer 134 is configured between the first electrically conductive disc 106 and the electrically conductive loops 126, a second dielectric layer 136 is configured between the electrically conductive loops 126 and the third electrically conductive disc 112, and a third dielectric layer 138 is configured between the third electrically conductive disc 112 and the second electrically conductive disc 108. The dielectric layers may be made of FR4, an epoxy compound, a ceramic, aluminium dioxide, or other dielectrics. An additional dielectric layer 164 is configured between the electrically conductive loops 126 and the third electrically conductive disc 112 In operation the electrically conductive loops 126*a*, 126*b*, 126*c*, 126*d*, are configured to inductively feed electromagnetic energy to the first electrically conductive disc 106. The operation is then similar to the operation of the antenna arrangement shown in FIG. 1A.

Figure 11:
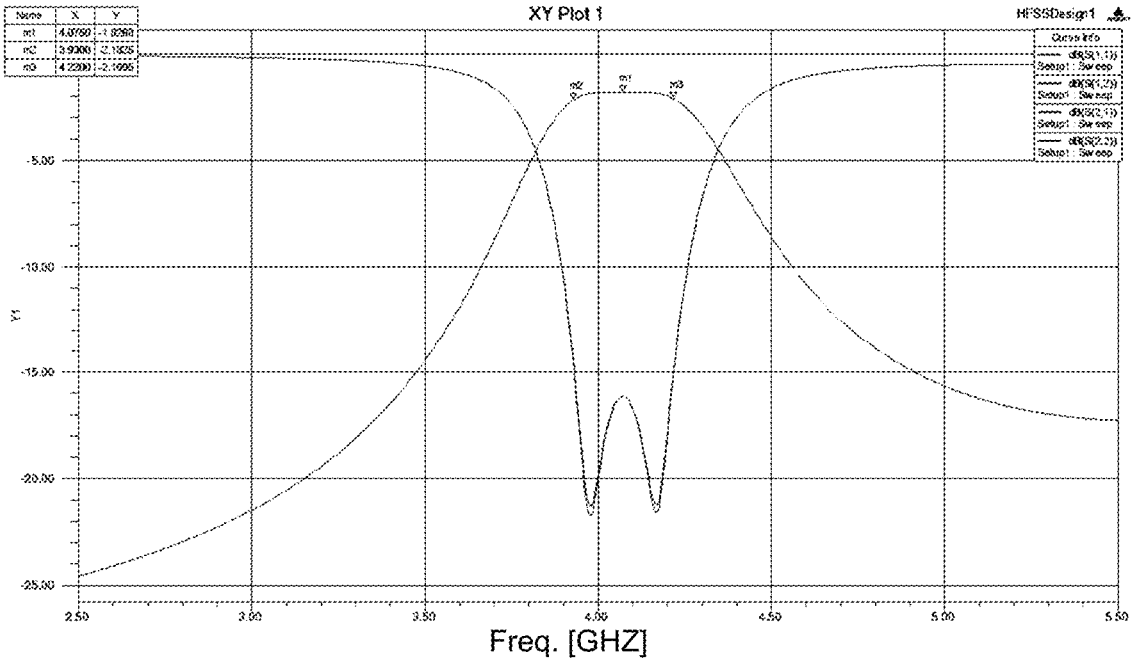
FIG. 11 shows the return loss and the insertion loss for the antenna arrangement in FIG. 8.

FIG. 11 shows the return loss and the insertion loss for the antenna arrangement in FIG. 7.

Figure 12A:
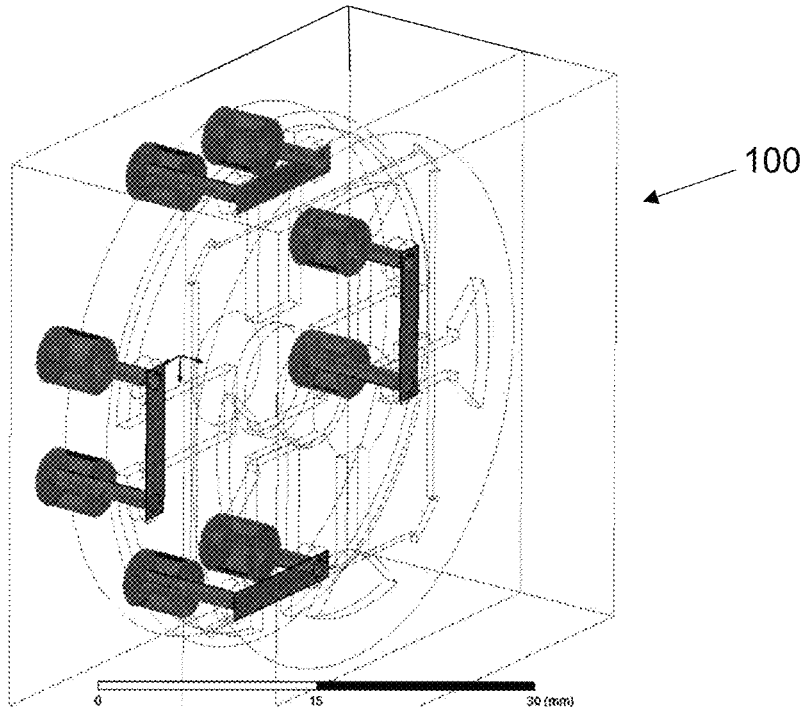
FIG. 12A shows an antenna arrangement according to another embodiment.
Figure 12B:
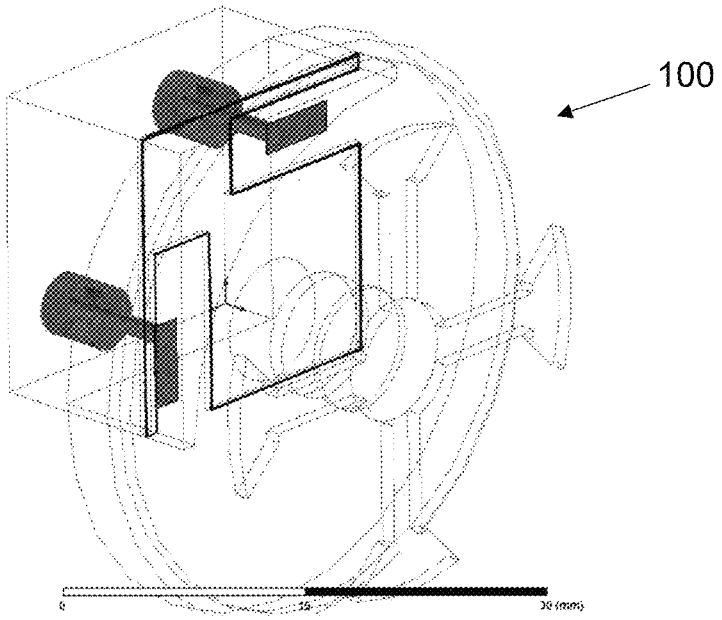
FIG. 12B shows a partial view of the antenna arrangement according to FIG. 12A.

FIG. 12A shows an antenna arrangement 100 according to another embodiment. FIG. 12B shows a partial view of the antenna arrangement according to FIG. 12A. The differences between the antenna arrangement in FIG. 7 and the antenna arrangement shown in FIG. 12A and FIG. 12B will be described with reference to FIG. 14.

Figure 13:
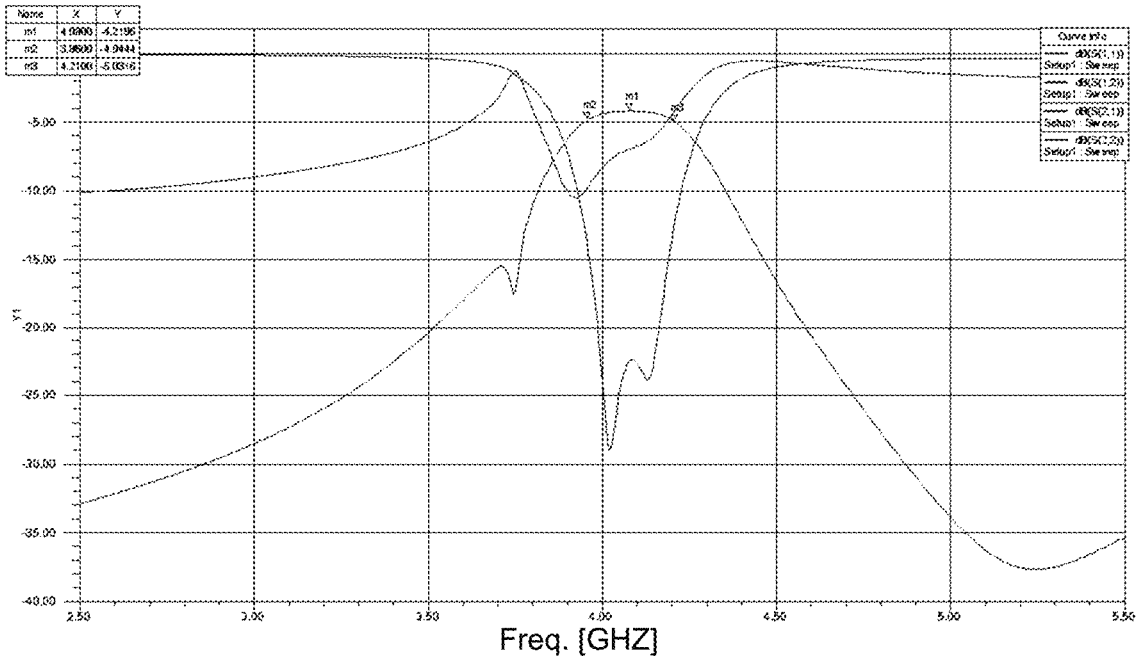
FIG. 13 shows the insertion loss and the return loss for the antenna arrangement in FIG. 12A.

FIG. 13 shows the insertion loss and the return loss for the antenna arrangement in FIG. 12A.

Figure 14:
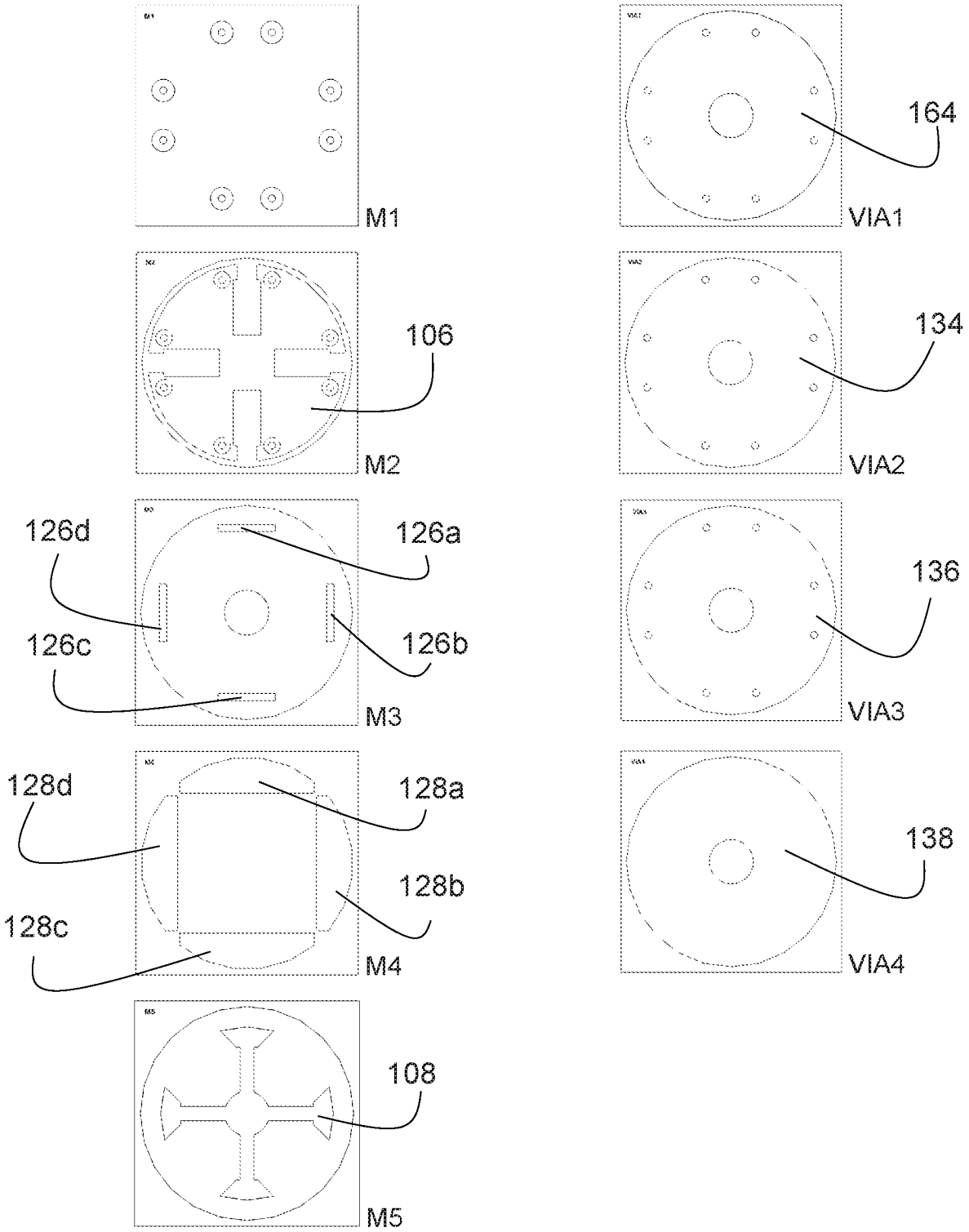
FIG. 14 shows the different layers in the antenna arrangement in FIG. 12A.

FIG. 14 shows the different layers in the antenna arrangement in FIG. 12A. The only difference compared to the layers shown in FIG. 10 is that the second electrically conductive disc 108 has a different shape than in FIG. 10.

Figure 15:
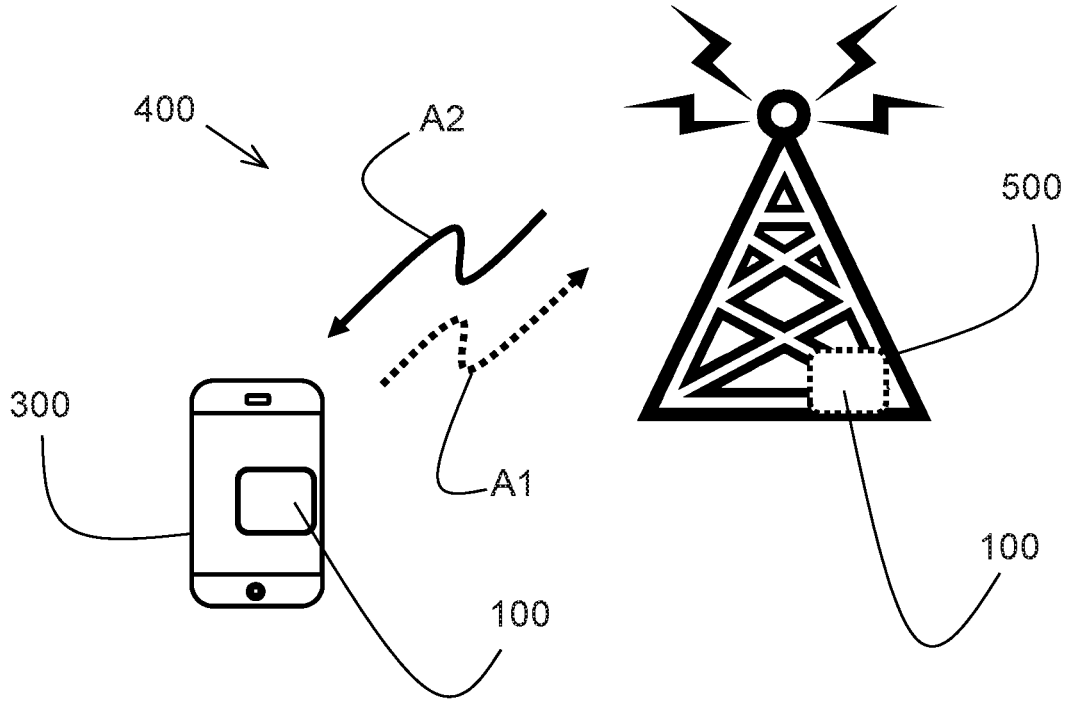
FIG. 15 shows schematically a communication device in a wireless communication system.

FIG. 15 shows schematically a communication device 300 in a wireless communication system 400. The communication device 300 comprises an antenna arrangement 100 according to an embodiment of the disclosure. The wireless communication system 400 also comprises a base station 500 which may also comprise an antenna arrangement 100 according to any one of the embodiments described above. The dotted arrow A1 represents transmissions from the transmitter device 300 to the base station 500, which are usually called up-link transmissions. The full arrow A2 represents transmissions from the base station 500 to the transmitter device 300, which are usually called down-link transmissions.

The present transmitter device 300 may be any of a User Equipment (UE) in Long Term Evolution (LTE), mobile station (MS), wireless terminal or mobile terminal which is enabled to communicate wirelessly in a wireless communication system, sometimes also referred to as a cellular radio system. The UE may further be referred to as mobile telephones, cellular telephones, computer tablets or laptops with wireless capability. The UEs in the present context may be, for example, portable, pocket-storable, hand-held, computer-comprised, or vehicle-mounted mobile devices, enabled to communicate voice or data, via the radio access network, with another entity, such as another receiver or a server. The UE can be a Station (STA), which is any device that contains an IEEE 802.11-conformant Media Access Control (MAC) and Physical Layer (PHY) interface to the Wireless Medium (WM).

The present transmitter device 300 may also be a base station a (radio) network node or an access node or an access point or a base station, e.g., a Radio Base Station (RBS), which in some networks may be referred to as transmitter, "eNB", "eNodeB", "NodeB" or "B node", depending on the technology and terminology used. The radio network nodes may be of different classes such as, e.g., macro eNodeB, home eNodeB or pico base station, based on transmission power and thereby also cell size. The radio network node can be a Station (STA), which is any device that contains an IEEE 802.11-conformant Media Access Control (MAC) and Physical Layer (PHY) interface to the Wireless Medium (WM).

Figure 16:
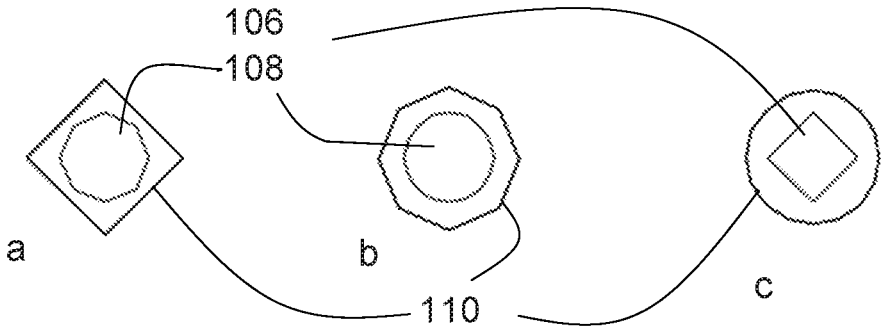
FIG. 16 illustrates different geometrical shapes on the discs and the cover as could be used in antenna arrangements according to embodiments of the present disclosure.

In the embodiments described above the discs are circular. However, as mentioned in the summary the order of axial symmetry of the discs and the cover may be an integer multiplied with four. FIG. 16 illustrates alternative geometrical shapes on the discs 106, 108, and the cover 110. In FIG. 16A the electrically conductive housing 110 has the shape of a square while the electrically conductive disc 106, 108, has an octagonal shape. In FIG. 16B the electrically conductive housing 110 has the shape of an octagon while the electrically conductive disc 106, 108, has a circular shape. In FIG. 16*c* the electrically conductive housing 110 has a circular shape while the electrically conductive disc has the shape of a square.

In general a disc can be solid disk which is for example arranged on the electrical conductor in form of a rod (disc on rod structure) but can also be a metal layer in disc form satisfying mentioned symmetry requirements on a PCB whereas the electrical conductor is formed by a via through the stack of metal layers and dielectric layers.

The use of the terms "a" and "an" and "the" and "at least one" and similar referents in the context of describing the disclosed subject matter (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or example language (e.g., "such as") provided herein, is intended merely to better illuminate the disclosed subject matter and does not pose a limitation on the scope of the invention unless otherwise claimed. No language in the specification should be construed as indicating any non-claimed element as essential to the practice of the invention.

Certain embodiments are described herein. Variations of those embodiments may become apparent to those of ordinary skill in the art upon reading the foregoing description. The inventors expect skilled artisans to employ such variations as appropriate, and the inventors intend for the embodiments to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An antenna arrangement comprising an electrical conductor extending along an axis;

a first electrically conductive disc in contact with the electrical conductor and extending perpendicularly from the axis, a second electrically conductive disc in contact with the electrical conductor and extending perpendicularly from the axis, an electrically conductive housing enclosing, circumferentially around the axis, the electrical conductor, the first electrically conductive disc and the second electrically conductive disc, feeding elements configured to feed electromagnetic energy to the first electrically conductive disc, transmitting elements configured to transmit electromagnetic energy from the second electrically conductive disc, and a third electrically conductive disc in contact with the electrical conductor and extending perpendicularly from the axis between the first electrically conductive disc and the second electrically conductive disc at a distance therefrom, wherein the third electrically conductive disc comprises a first opening, a second opening, a third opening and a fourth opening;

wherein the first electrically conductive housing comprises a first end wall enclosing the electrical conductor axially on a side proximal to the first electrically conductive disc, and a second end wall enclosing the electrical conductor axially on a side proximal to the second electrically conductive disc;

wherein the antennal arrangement is further configured to form a first cavity between the first end wall and the third electrically conductive disc, and a second cavity between the third electrically conductive disc and the second end wall; and wherein the first opening, the second opening, the third opening and the fourth opening are configured to ensure no coupling between orthogonal modes of the first cavity and the second cavity.

2. The antenna arrangement according to claim 1, wherein at least one of the first electrically conductive disc and the second electrically conductive disc is symmetrical around the axis.

3. The antenna arrangement according to claim 1, wherein at least one of the first electrically conductive disc and the second electrically conductive disc around the axis has n-fold axial symmetry, n being an integer multiplied by a factor of four.

4. The antenna arrangement according to claim 1, wherein the third electrically conductive disc around the axis has n-fold axial symmetry, n being an integer multiplied by a factor of four.

5. An antenna arrangement comprising an electrical conductor extending along an axis;

a first electrically conductive disc in contact with the electrical conductor and extending perpendicularly from the axis, a second electrically conductive disc in contact with the electrical conductor and extending perpendicularly from the axis, an electrically conductive housing enclosing, circumferentially around the axis, the electrical conductor, the first electrically conductive disc and the second electrically conductive disc, feeding elements configured to feed electromagnetic energy to the first electrically conductive disc, transmitting elements configured to transmit electromagnetic energy from the second electrically conductive disc, and a third electrically conductive disc in contact with the electrical conductor and extending perpendicularly from the axis between the first electrically conductive disc and the second electrically conductive disc at a distance therefrom, wherein the third electrically conductive disc comprises at least one opening;

wherein the electrically conductive housing comprises a first end wall enclosing the electrical conductor axially on a side proximal to the first electrically conductive disc; and wherein the feeding elements comprise feeding probes configured in proximity to the first electrically conductive disc and extending through the first end wall, wherein the feeding probes are configured to capacitively feed electromagnetic energy to the first electrically conductive disc.

6. The antenna arrangement according to claim 5, wherein the feeding probes are configured symmetrically around the axis.

7. The antenna arrangement according to claim 6, wherein a number of feeding probes is an integer multiplied by a factor of four.

8. An antenna arrangement comprising an electrical conductor extending along an axis;

a first electrically conductive disc in contact with the electrical conductor and extending perpendicularly from the axis, a second electrically conductive disc in contact with the electrical conductor and extending perpendicularly from the axis, an electrically conductive housing enclosing, circumferentially around the axis, the electrical conductor, the first electrically conductive disc and the second electrically conductive disc, feeding elements configured to feed electromagnetic energy to the first electrically conductive disc, transmitting elements configured to transmit electromagnetic energy from the second electrically conductive disc, and a third electrically conductive disc in contact with the electrical conductor and extending perpendicularly from the axis between the first electrically conductive disc and the second electrically conductive disc at a distance therefrom, wherein the third electrically conductive disc comprises at least one opening;

wherein the electrically conductive housing comprises a first end wall enclosing the electrical conductor axially on a side proximal to the first electrically conductive disc; and wherein the feeding elements comprise electrically conductive loops configured between the first electrically conductive disc and the third electrically conductive disc, wherein the electrically conductive loops are configured to inductively feed electromagnetic energy to the first electrically conductive disc.

9. The antenna arrangement according to claim 8, wherein each electrically conductive loop comprises two feed points, wherein the first electrically conductive disc comprises slots extending from a periphery of the first electrically conductive disc, and wherein the feed points for each electrically conductive loop are configured on separate sides of the slots.

10. The antenna arrangement according to claim 8, wherein the electrically conductive loops are configured symmetrically around the axis.

11. The antenna arrangement according to claim 8, further comprising a first dielectric layer positioned between the first electrically conductive disc and the electrically conductive loops, a second dielectric layer positioned between the electrically conductive loops and the third electrically conductive disc, and a third dielectric layer positioned between the third electrically conductive disc and the second electrically conductive disc.

12. An antenna arrangement comprising an electrical conductor extending along an axis;

a first electrically conductive disc in contact with the electrical conductor and extending perpendicularly from the axis, a second electrically conductive disc in contact with the electrical conductor and extending perpendicularly from the axis, an electrically conductive housing enclosing, circumferentially around the axis, the electrical conductor, the first electrically conductive disc and the second electrically conductive disc, feeding elements configured to feed electromagnetic energy to the first electrically conductive disc, transmitting elements configured to transmit electromagnetic energy from the second electrically conductive disc, and a third electrically conductive disc in contact with the electrical conductor and extending perpendicularly from the axis between the first electrically conductive disc and the second electrically conductive disc at a distance therefrom, wherein the third electrically conductive disc comprises at least one opening;

wherein the electrically conductive housing comprises a second end wall enclosing the electrical conductor axially on a side proximal the second electrically conductive disc; and wherein the transmitting elements comprise radiating elements in electrical contact with the second electrically conductive disc and extending through the second end wall.

13. The antenna arrangement according to claim 12, wherein the radiating elements are configured symmetrically around the axis.

14. The antenna arrangement according to claim 13, wherein the number of radiating elements is an integer multiplied by a factor of four.

* * * * *